US005695351A

United States Patent [19]

Kimura et al.

[11] Patent Number: 5,695,351

[45] Date of Patent: Dec. 9, 1997

[54] ELECTRICAL CONNECTOR EQUIPPED WITH A RELEASE MECHANISM

[75] Inventors: Akira Kimura; Tadashi Ishiwa, both of Tokyo, Japan

[73] Assignee: Japan Aviation Electronics Industry, Ltd., Tokyo, Japan

[21] Appl. No.: 503,715

[22] Filed: Jul. 18, 1995

[30] Foreign Application Priority Data

Jul. 18, 1994 [JP] Japan ..... 6-165194

[51] Int. Cl.[6] ..... H01R 13/62

[52] U.S. Cl. ..... 439/159

[58] Field of Search ..... 439/159, 160

[56] References Cited

U.S. PATENT DOCUMENTS

| | | | |
|---|---|---|---|
| 4,648,009 | 3/1987 | Beun et al. | 439/160 X |
| 4,778,395 | 10/1988 | Narita | 439/159 X |
| 5,139,435 | 8/1992 | Komatsu et al. | 439/159 |
| 5,149,276 | 9/1992 | Dixon | 439/159 |
| 5,281,157 | 1/1994 | Abe et al. | 439/159 |
| 5,305,180 | 4/1994 | Mitchell et al. | 439/159 X |
| 5,368,493 | 11/1994 | O'Brien et al. | 439/160 |

*Primary Examiner*—Allan N. Shoap
*Assistant Examiner*—Christopher J. McDonald

[57] ABSTRACT

A release mechanism comprises an ejector formed on a frame member to be movable forward and backward, and a lever rotated in response to a forward movement of the ejector to release a mating connector from conductive contacts. The ejector is located in an opening of the frame member in a normal condition in which the mating connector is inserted in the from member. The ejector is protruded outside the opening only start of releasing operation of the mating connector. The ejector has a first mode enabling a predetermined forward movement and a second mode disabling the predetermined forward movement. The release mechanism further comprises members for cancelling the first mode and putting the ejector into the second mode after the mating connector is released from the conductive contacts, and members for restoring the first mode of the ejector from the second mode in response to an external operation of the ejector while the mating connector is connected to the conductive contacts. The ejector is turned from the first mode into the second mode at the time instant immediately after the mating connector is released from the conductive contacts.

3 Claims, 14 Drawing Sheets

ELECTRICAL CONNECTOR EQUIPPED WITH A RELEASE MECHANISM

BACKGROUND OF THE INVENTION

This invention relates to an electrical connector to be connected to a mating connector and, in particular, to an electrical connector equipped with a release mechanism for releasing a mating connector from connection with the electrical connector.

A conventional connector comprises a plurality of conductive contacts, and an insulator frame member supporting the conductive contacts. The frame member has an opening for insertion of a mating connector and a guide portion for guiding the mating connector into connection with the contacts.

The connector is provided with a release mechanism mounted on the frame member for releasing the mating connector from the connection. The release mechanism comprises an ejector mounted on the frame member to be movable forward and backward in a travelling direction and a lever rotatably mounted on the frame member and controlled its rotating movement by the ejector. The release mechanism is in a first condition when the mating connector is in the connection with the connector. In the first condition, the ejector is disposed in a first or backward position in the travelling direction. The release mechanism is in a second condition after releasing the mating connector from the connection. In the second condition, the ejector is disposed at a second or forward position in the travelling direction.

The connector is further provided with a detecting element for detecting an insertion of the mating connector into the guide portion so as to move the ejector from the forward position to the backward position to allow the mating connection to further move forward into connection with the contacts.

In detail, the detecting element is formed in the guide portion and is pressed outwardly from the guide potion to engage with the ejector when detecting the insertion of the mating connector into the guide. In response to the engagement, the ejector is released from the forward position to the backward position. Thus, the release mechanism is brought into the first condition and the mating connector can be brought into connection with the conductive contacts.

In the conventional connector described above, when the mating connector is in connection with the conductive contacts, the detecting element is pressed outwardly. The ejector is in the first position.

When the ejector is moved into the second or forward position in order to remove the mating connector from the connection, the ejector is pushed in the forward direction. In this event, the ejector is brought into engagement with the detecting element pressed outwardly. As a result, the ejector fails to be moved to the second or forward position so that the mating connector is not released.

In order to avoid the failure, the ejector and the detecting element must be arranged in an accurate positional relationship therebetween. This makes a facility and production of the connector complication.

SUMMARY OF THE INVENTION

It is an object of this invention to provide an electrical connector equipped with a release mechanism, wherein the release mechanism is operable to reliably release a mating connector from connection with the connector.

It is another object of this invention to provide an electrical connector equipped with a release mechanism, which is capable of allowing insertion of the a mating connector thereinto for electrical connection and release the mating connector from the electrical connection without provision of any detecting element which is pressed outwardly by insertion of the mating connector inserted to engage with the release mechanism.

It is a further object of this invention to provide an electrical connector equipped with a release mechanism, which is capable of turning on and off a switch in dependence upon a location of an ejector.

According to this invention, there is provided an electrical connector equipped with a release mechanism, comprising a plurality of conductive contacts, a frame member supporting the conductive contacts and provided with an opening for receiving a mating connector inserted through the opening so that the mating connector is movable in forward and backward directions to be connected to and released from the conductive contacts, respectively, and the release mechanism for carrying out a predetermined forward movement to release the mating connector from the conductive contacts, the releasing mechanism comprising an ejector mounted on the frame member to be movable in the forward and the backward directions, and a lever which is rotated in response to the forward movement of the ejector to release the mating connector from the conductive contacts and which is rotated by the mating connector and forces the ejector to move in the backward direction when the mating connector is inserted into the frame member, wherein the ejector is located inward from the opening in a normal condition in which the mating connector is inserted in the frame member, the ejector being protruded outward from the opening to achieve the predetermined forward movement only during a releasing operation of the mating connector.

According to this invention, there is also provided an electrical connector equipped with a release mechanism, wherein the ejector has a first mode enabling the predetermined forward movement and a second mode disabling the predetermined forward movement, the electrical connector further comprising:

means for cancelling the first mode of the ejector to put the ejector into the second mode after the mating connector is released; and means for restoring the first mode of the ejector from the second mode so as to release the mating connector from the connection with the conductive contacts.

Further, according to this invention, there is provided with an electrical connector equipped with a release mechanism, wherein the frame member has a holder portion for holding the ejector to be movable in the forward and the backward directions with respect to the mating connector, the ejector being variable in length in the forward and the backward directions and comprising an outer member and an inner member slidably coupled to each other, the outer member and the inner member being engaged with each other in an elongated condition when the ejector is in the first mode, the outer member and the inner member are out of engagement to each other when the ejector is in the second mode;

the holder portion having means for releasing, after releasing the mating connector, engagement between the outer member and the inner member to establish the second mode of the ejector.

According to this invention, there is further provided an electrical connector equipped with a releasing mechanism, wherein the holder portion has a switch turned from an off state into an on state when the ejector is in the first mode while the ejector is protruding from the connector in the backward direction.

Figure 6:
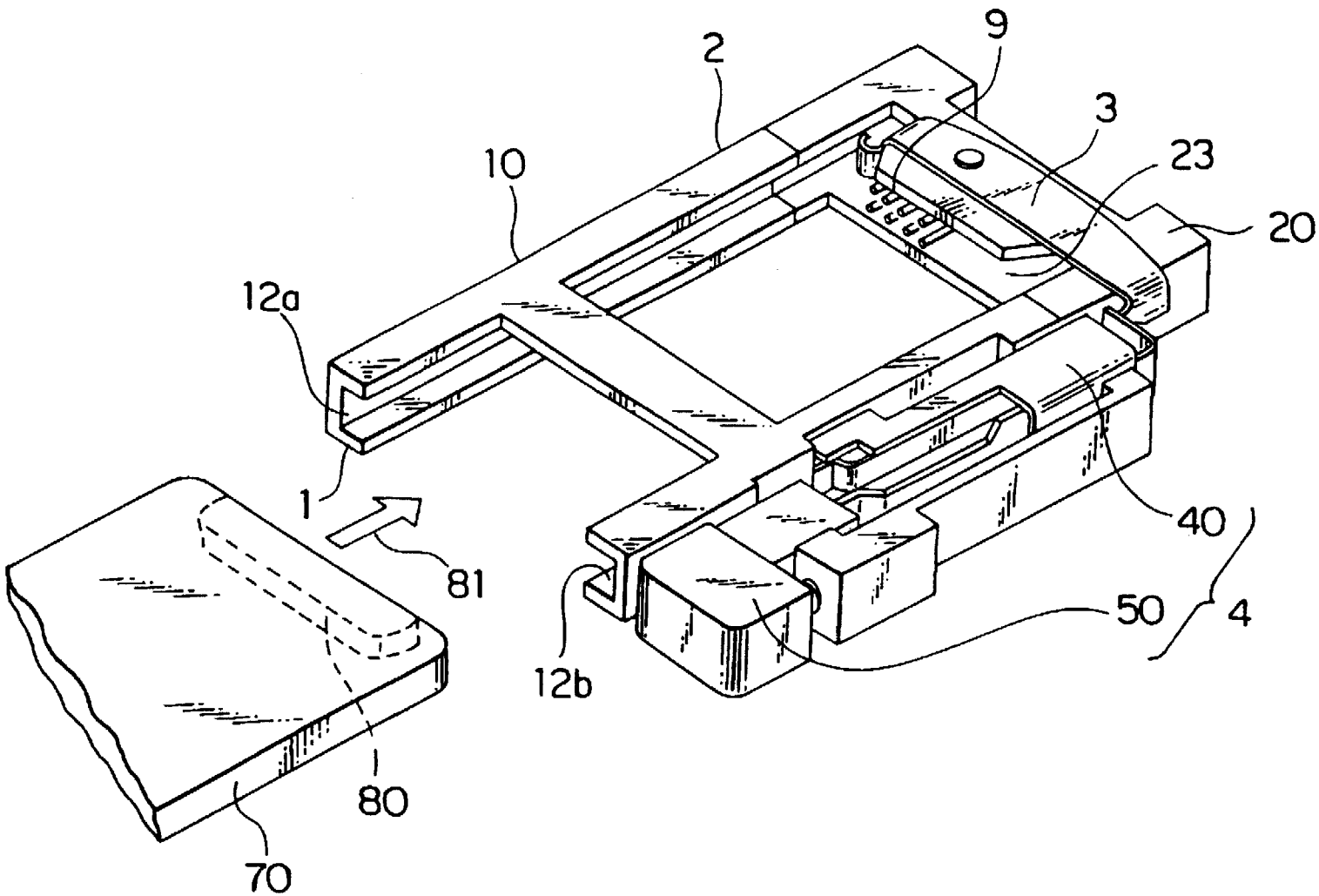
FIG. 6 is a perspective view of a connector equipped with a releasing mechanism according to one embodiment of this invention with an ejector in a storage condition.
Figure 14:
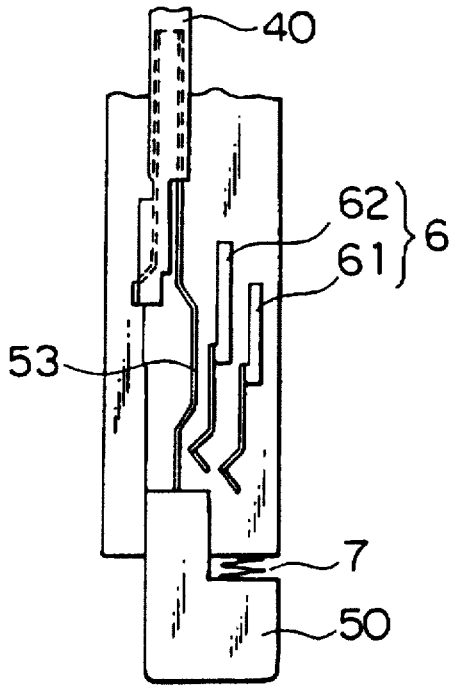
Figure 15:
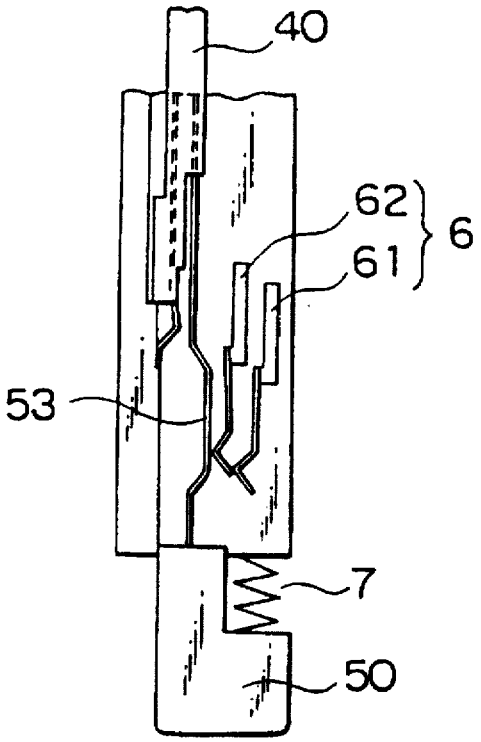

FIG, 13 is an exploded perspective view for describing a condition after a mating connector is released by a forward movement of the ejector illustrated in FIG. 6;

FIG. 14 is a view for describing an electrical connector according to another embodiment of this invention in a condition where a switch is turned off; and FIG. 15 is a view for describing another condition where the switch in FIG. 14 is turned on.

DESCRIPTION OF THE PREFERRED EMBODIMENTS

Prior to description of this invention, a conventional connector will be described with reference to FIGS. 1 through 5 to facilitate an understanding of this invention.

Figure 1:
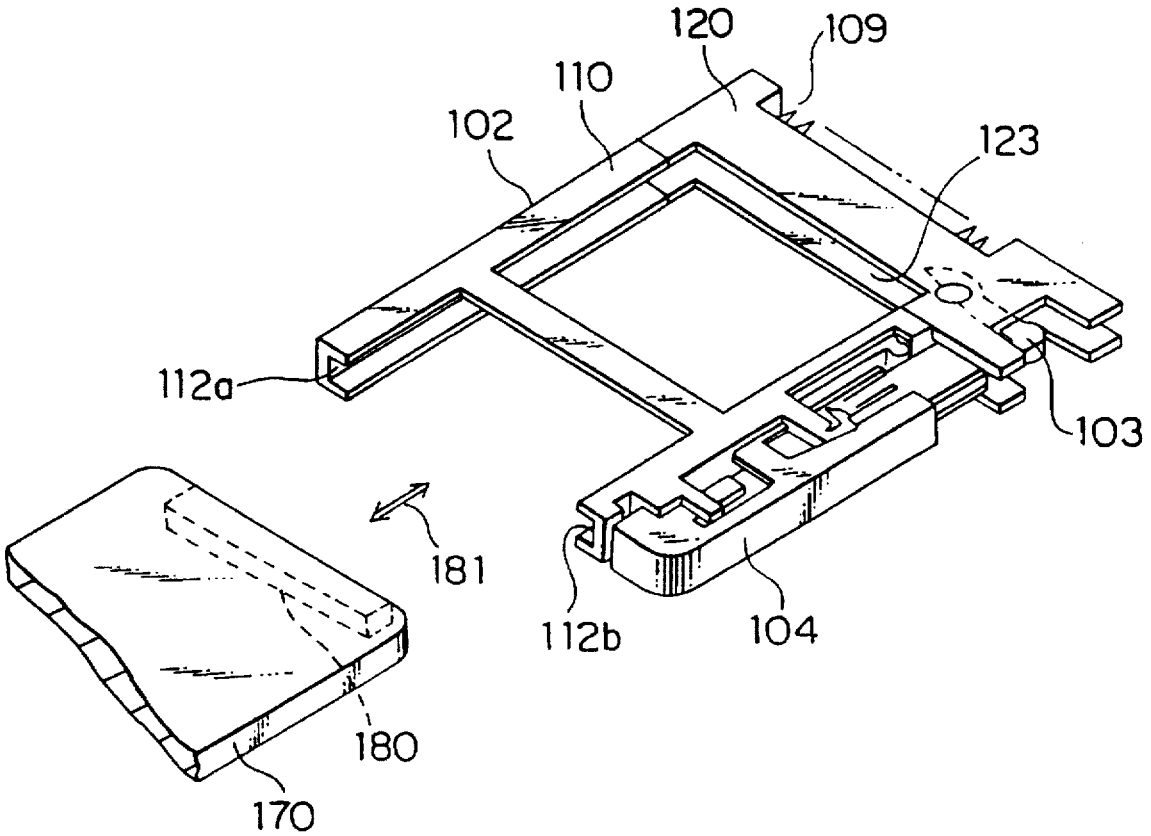
PRIOR ART FIG. 1
FIG. 1 is a perspective view of a conventional electrical connector.

Referring to FIG. 1, a conventional connector with a release mechanism comprises a frame member 102 formed by a guide frame 110 and a contact frame 120. The release mechanism comprises a lever 103 rotatably mounted on the frame member 102 and an ejector 104 mounted on the frame member 102 to be movable forward and backward.

Figure 2:
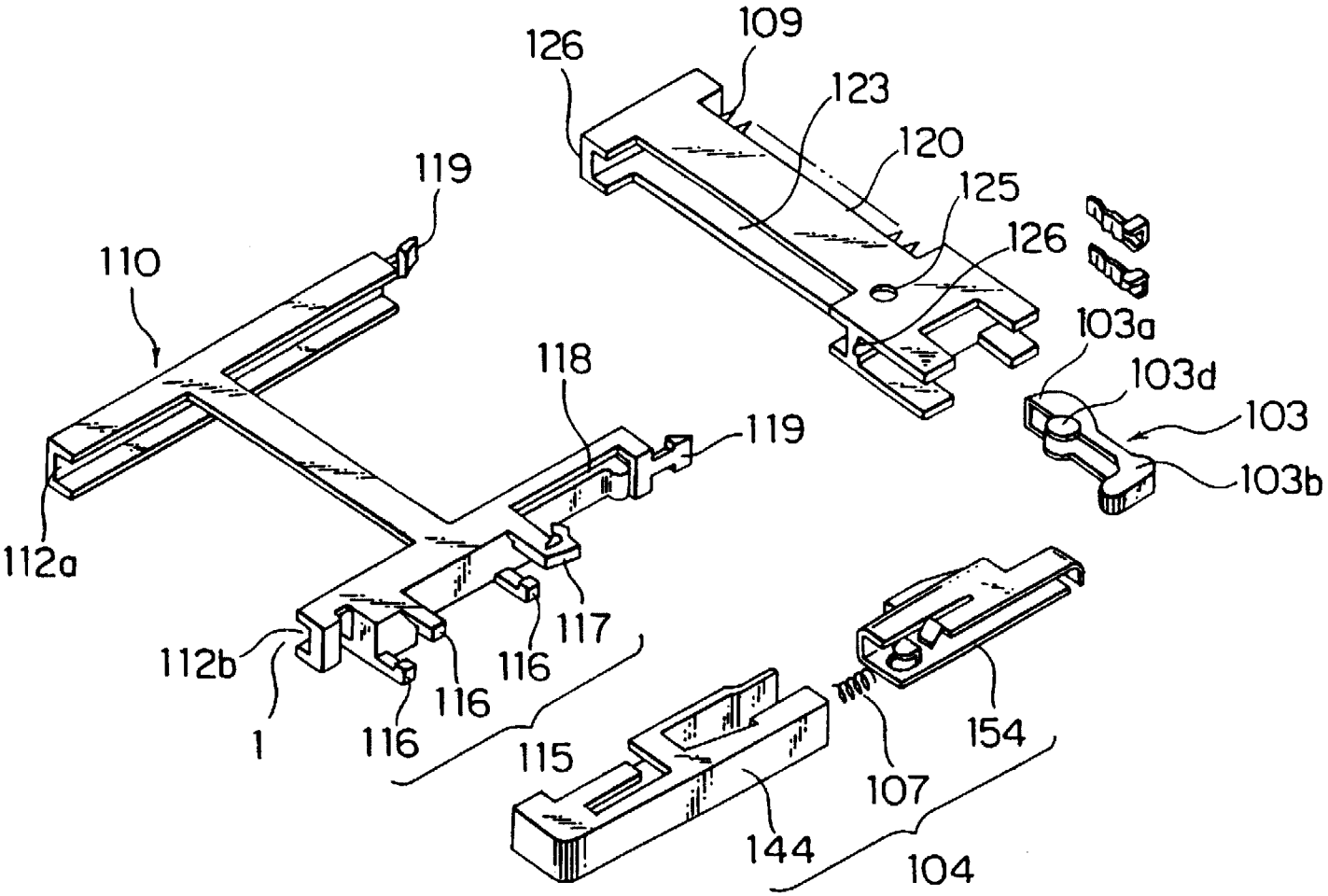
PRIOR ART FIG. 2
FIG. 2 is an exploded perspective view of the electrical connector illustrated in FIG. 1.

Referring to FIG. 2 in addition, the guide frame 110 defines an opening for insertion of a card 170, such as an IC card and a memory card, which has a mating connector 180 at a forward end. The guide frame 110 has a pair of guide portions 112*a* and 112*b* extending in parallel to each other for guiding the card 170 inserted into and removed from the frame member 102 in forward and backward directions depicted by a double-headed arrow 181 in FIG. 1. The forward and the backward directions may collectively be called a travelling direction. The contact frame 120 defines a cavity 123 for receiving the forward end of the card 170 inserted and fitted therein. The cavity 123 accommodates a plurality of conductive pin contacts 109 to be connected in one-to-one correspondence to a plurality of mating contacts (not shown) of the mating connector 180 when the card 170 is inserted. The guide frame 110 and the contact frame 120 are coupled to each other by a pair of coupling protrusions 119 and a pair of coupling recesses 126.

The guide portions 112*a* and 112*b* slidably receive opposite side edges of the card 170 in the travelling direction. One guide portion 112*b* is provided with a holder portion 115 formed on its outside for holding the ejector 104 movable forward and backward. The holder portion 115 has four holder elements 116 and 117 at four different positions. As illustrated in detail in FIG. 3, one holder element 117 comprises a wedge 117*a*, a groove 117*b* formed in a base portion of the wedge 117*a*, and a jaw 117*c* at the end of the wedge 117*a*. The base portion has an elasticity. When the wedge 117*a* of the holder element 117 is subjected to a pressing force, a gap in the groove 117*b* is reduced and the jaw 117*c* is moved towards the one guide portion 112*b*. When the pressing force against the wedge 117*a* is released, the jaw 117*c* is returned to its initial position by elastic restoring force of the base portion having the groove 117*b*.

Figure 3:
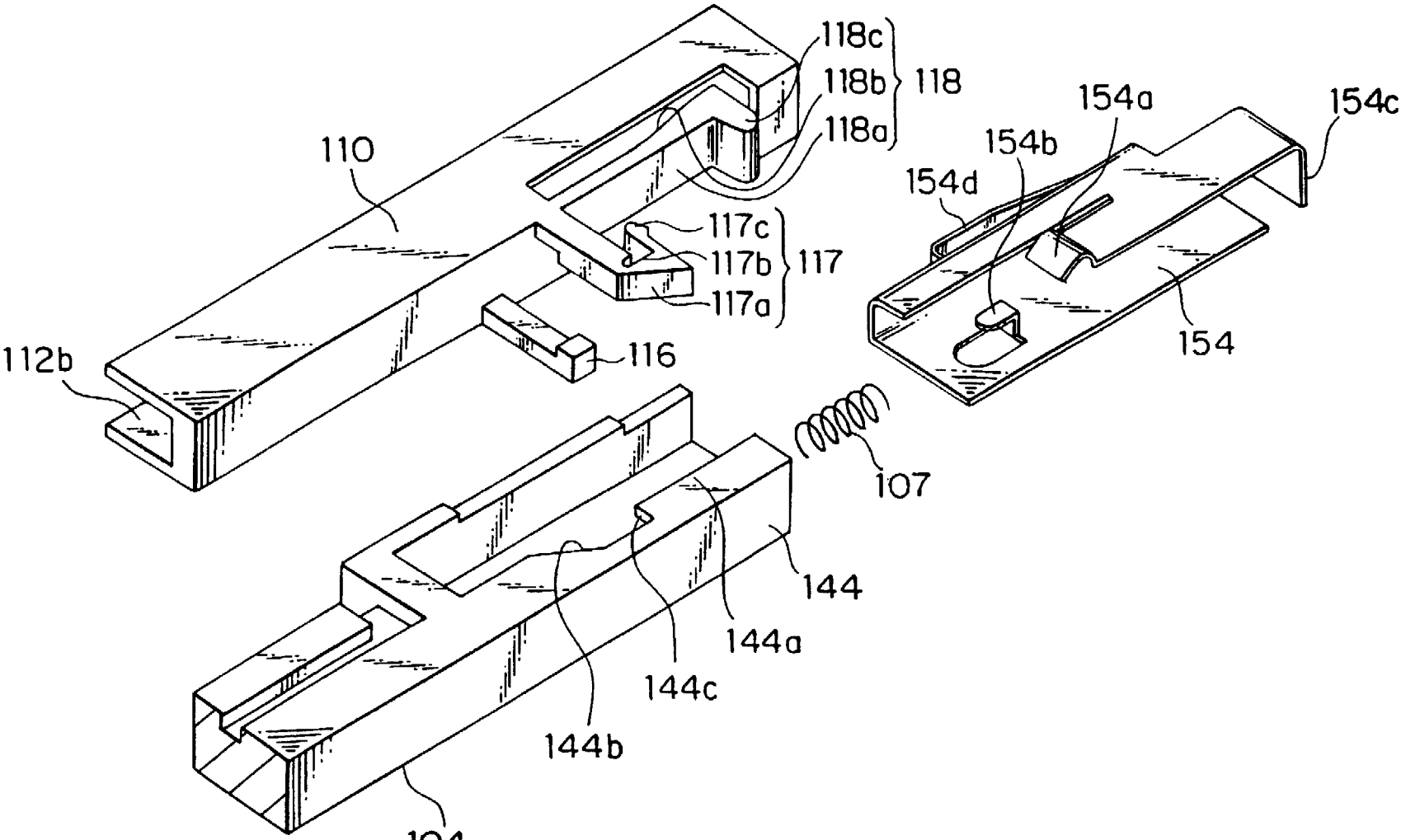
PRIOR ART FIG. 3
FIG. 3 is an exploded and enlarged perspective view of an ejector of the electrical connector illustrated in FIG. 1.

The one guide portion 112*b* has a detecting element 118 formed at its rear side, namely, near to the contact frame 120. As illustrated in FIG. 3, the detecting element 118 comprises a leaf spring portion 118*a*, a tapered portion 118*b*, and a head portion 118*c*. One end of the leaf spring portion 118*a* is integrally connected to the one guide portion 112*b*. The tapered portion 118*b* extends from the opposite end of the leaf spring portion 118*a* and is protruded into the guide portion 112*b*. The head portion 118*c* is formed on an outer surface of the tapered portion 118*b*.

When the card 170 is inserted through the opening into the frame member 102, a side edge of the card 170 is brought into contact with the tapered portion 118*b* of the detecting element 118. When the card 170 is forced to advance further, the card 170 performs a sliding movement in contact with the tapered portion 118*b* which is pushed outward by the card 170. As a consequence, the head portion 118*c* is outwardly protruded towards the ejector 104 and located at a protruding position when the card 170 is received in the cavity 123 with the mating connector 180 connected to the contacts 109.

On the other hand, when the card 170 is removed from the cavity 123 with the mating connector 180 released from the contacts 109, the side edge of the card 170 is out of contact with the tapered portion 118*b*. The head portion 118*c* is responsive to an elastic restoring force of the leaf spring portion 118*a* and returns to an initial position before the card 170 is inserted. Thus, the head portion 118*c* of the detecting element 118 is displaced between the initial position and the protruding position in response to insertion and removal of the card 170.

The contact frame 120 is provided with a shaft receiving hole 125 for rotatably supporting the lever 103.

The lever 103 comprises a push-out portion 103*a*, a pressed portion 103*b*, and a rotation shaft 103*d* formed at one end, the other end, and an intermediate portion, respectively. The lever 103 is rotatably held in the contact frame 120 by rotatably inserting the rotation shaft 103*d* in the shaft receiving hole 125 formed in the contact frame 120.

The push-out portion 103*a* of the lever 103 is located at a rear side of the cavity 123 when the card 170 is inserted in the frame member 102. In order to remove the card 170 from the frame member 102, the ejector 104 performs a forward movement and pushes the pressed portion 103*b*. This brings about a rotary movement of the lever 103 around the rotation shaft 103*d*. As a consequence, the push-out portion 103*a* is protruded in the cavity 123 to push the card 170 out of the cavity 123 together with the mating connector 180 released from the contacts 109.

As illustrated in FIGS. 1 through 3, the ejector 104 comprises an outer member 144 and an inner member 154.

The outer member 144 is supported by the holder portion 115, in detail, by three holder elements 116 and is movable forward and backward. The outer member 144 is provided therein with a groove portion 144*a* for receiving a spring 107 and the inner member 154. The outer member 144 is provided with a tapered portion 144*b* and an engaging portion 144*c* for receiving and engaging the wedge portion 117*a*. The inner member 154 is movably fitted into the groove portion 144*a* of the outer member in the travelling direction. The inner member 154 is provided with a ridge 154*a*, a spring holder 154*b*, an ejector pusher 154*c*, and a stopper 154*d*. The ridge 154*a* is elastically deformed upward and downward in the figure. The stopper 154*d* elastically protrudes outwardly of the inner member and towards the guide portion 112*b* and can be pressed inwardly by the head portion 118*c*. When the inner member 154 is in a position so that the stopper 154*d* is out of the groove portion 144*a*, the stopper 154*d* elastically protrudes outwardly and engage with an edge of the groove portion 144*a* to prevent the inner member 154 from inserting into the groove portion 144*a*.

Figure 4:
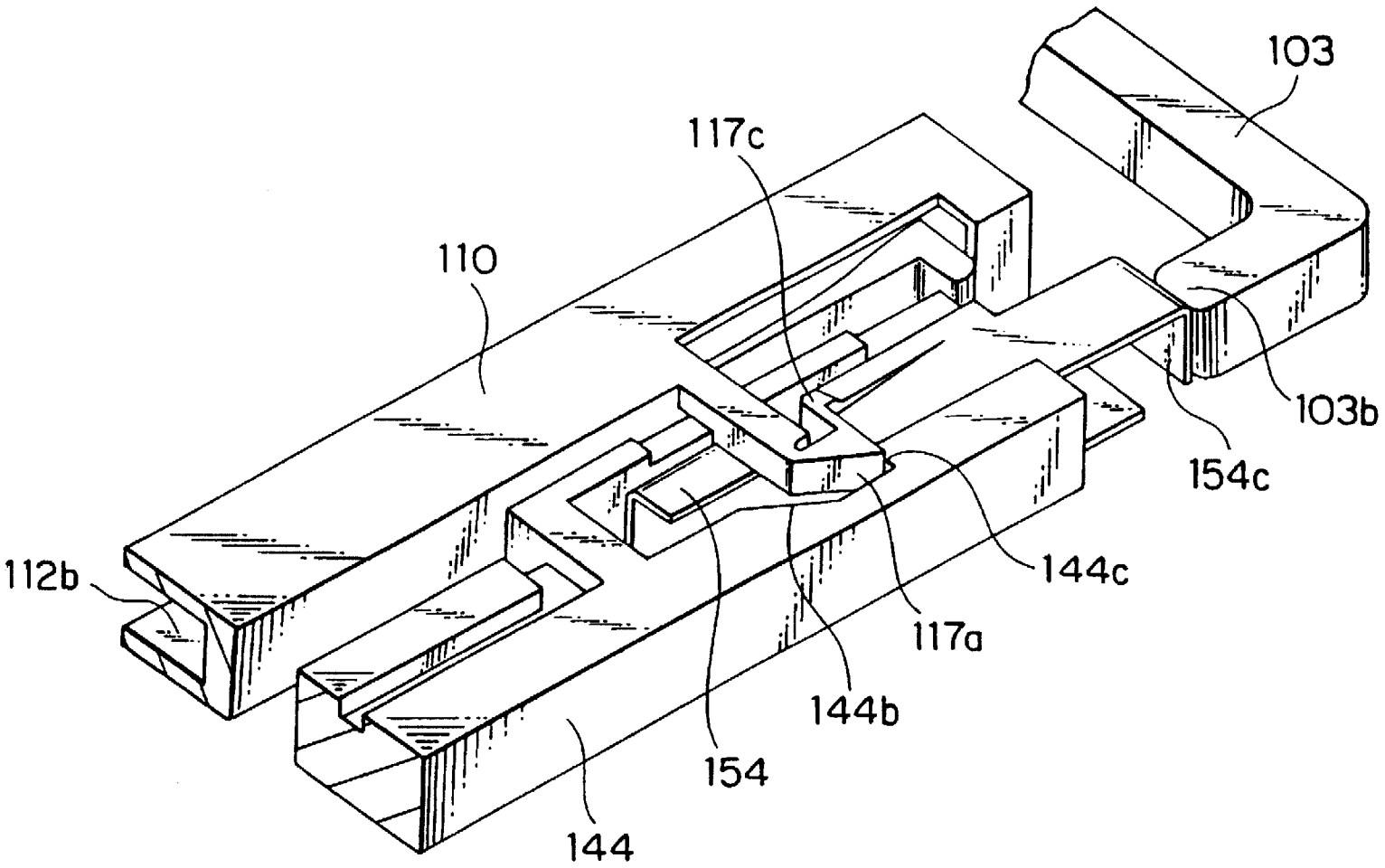
PRIOR ART FIG. 4
FIG. 4 is an enlarged perspective view of the ejector illustrated in FIG. 1 in an initial condition.

Referring to FIGS. 1, 3, and 4, when the outer member 144 is disposed at a normal position in the travelling direction, the wedge 117*a* is received in the engaging portion 144*c* of the outer member 144, as show in FIG. 4. In this state, the ejector 104 is retained in a condition not projecting from the connector in the backward direction but restoring in the connector.

Figure 5:
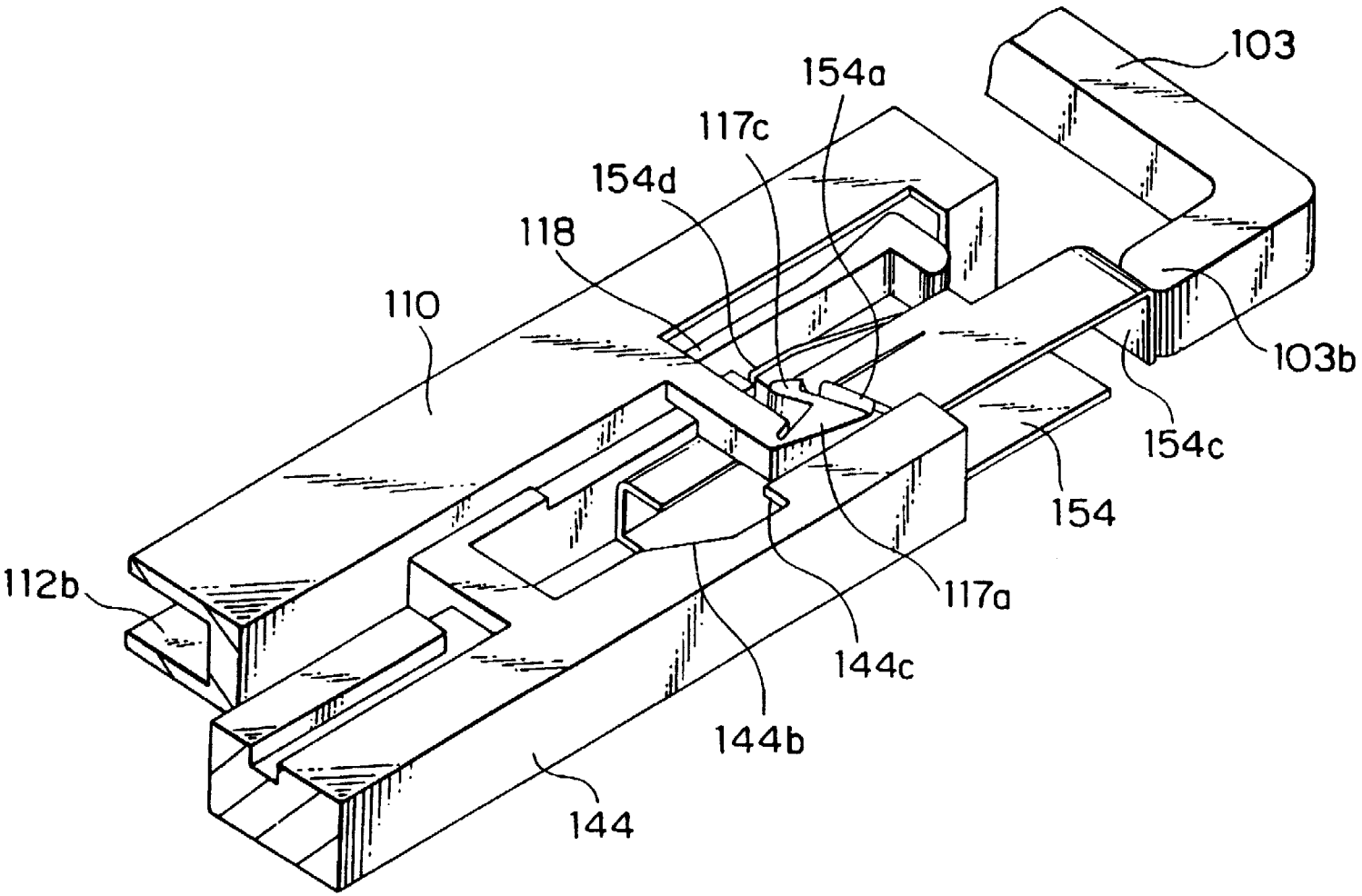
PRIOR ART FIG. 5
FIG. 5 is an enlarged perspective view of the ejector illustrated in FIG. 1 in a protruding condition.

In the state, when the inner member 154 is disposed in the groove portion 144*a* with the stopper 154*d* being pressed inwardly in the groove portion 144*a*, the ridge 154*a* of the inner member 154 is pressed against the bottom of the jaw 117*c* of the holder element 117. When the ejector 104 is pushed and moved in the forward direction, the tapered portion 144*b* is pressed against the wedge 117*a* to move the jaw 117*b* towards the guide portion 112*b* to a displaced position, as illustrated in FIG. 5. At the same time, the inner member 154 is also moved in the forward direction through a spring 107. Accordingly, the ridge 154*a* is exposed and restored to be raised so that the jaw 117*b* is retained at the displaced position. Thus, the wedge 117*a* is released from engagement with the engaging portion 144*c*. As a consequence, the outer member 144 is pushed by the spring 107 in the backward direction and is protruded outside of the connector, as shown in FIG. 5. The outer member 144 is stopped from further moving in the backward direction by engagement with the holder element 116. In the condition, the stopper 154*d* escapes out of the groove portion 144*a* to engage the edge of the groove portion 1441*a* of the outer member 144. Thus, the ejector 104 is elongated in the travelling direction. The condition of the ejector 104 is referred to as an elongated mode.

When the outer member 144 protruded outside is pushed in the forward direction, this pushing force is transmitted from the outer member 144 to the inner member 154 via the stopper 154*d* to make the ejector pusher 154*c* push the pressed portion 103*b* of the lever 103. As a result, the lever 103 is rotated about the rotation shaft 103*d* so that the push-out portion 103*a* pushed the forward end of the card into the backward direction. Accordingly, the card 170 is removed from the cavity 123 with the mating connector 180 released from the contacts 109. At this time, the ridge 154*a* is moved forward with the forward movement of the ejector 104 and released from engagement with the jaw 117*b* which is then returned to its initial position. The wedge 117*a* is received in the engaging portion 114*c* to be engaged therewith. Accordingly, the outer member 144 is retained at the normal position, as shown in FIG. 4, but the ejector 104 is maintained in the elongated mode. The inner member 154 is positioned at a most forward position.

Thereafter, when the card 170 is again inserted into the guide frame 110, the side edge of the card 170 is pressed against the tapered portion 118*b* of the detecting element 118 of the tapered portion 112*b* to protrude the head portion 118*c* towards the inner member 154 of the ejector 104. The head portion 118*c* pushes the stopper 154*d* inwardly of the inner member 154 to release the engagement of the stopper 154*d* with the edge of the outer member 144. As a result, the outer member 144 and the inner member 154 are brought into a relatively movable condition, so that the ejector 104 is variable in length. The condition is referred to as a length variable mode. Therefore, the forward end of the card 170 can rotate the lever 103 so that the pressing portion 103*b* pushes the inner member 154 of the ejector 104 into the groove portion 144*a* of the outer member 144, as illustrated in FIG. 4. As a result, the mating connector 180 of the card 170 is electrically connected to the conductive contacts of the connector.

Now, description will proceed to a connector equipped with a releasing mechanism according to one embodiment of this invention with reference to the drawings.

Figure 7:
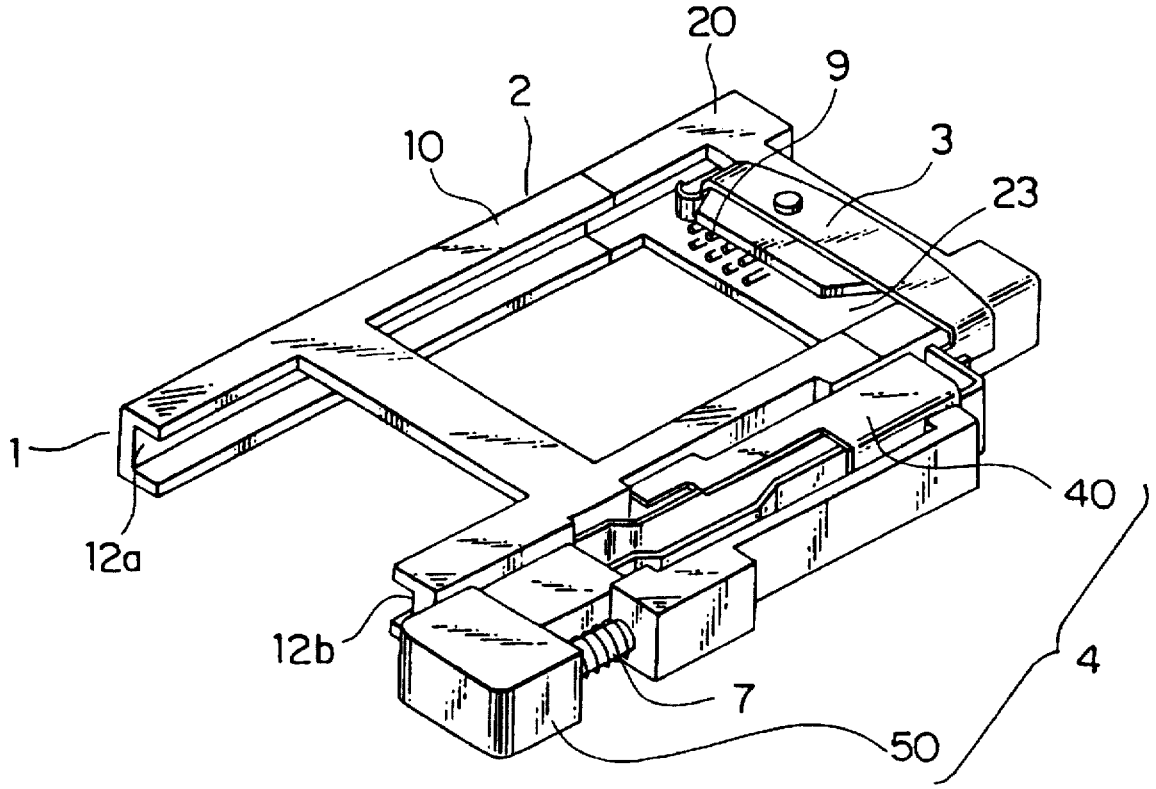
FIG. 7 is a perspective view of the ejector illustrated in FIG. 6 in a protruding condition.
Figure 8:
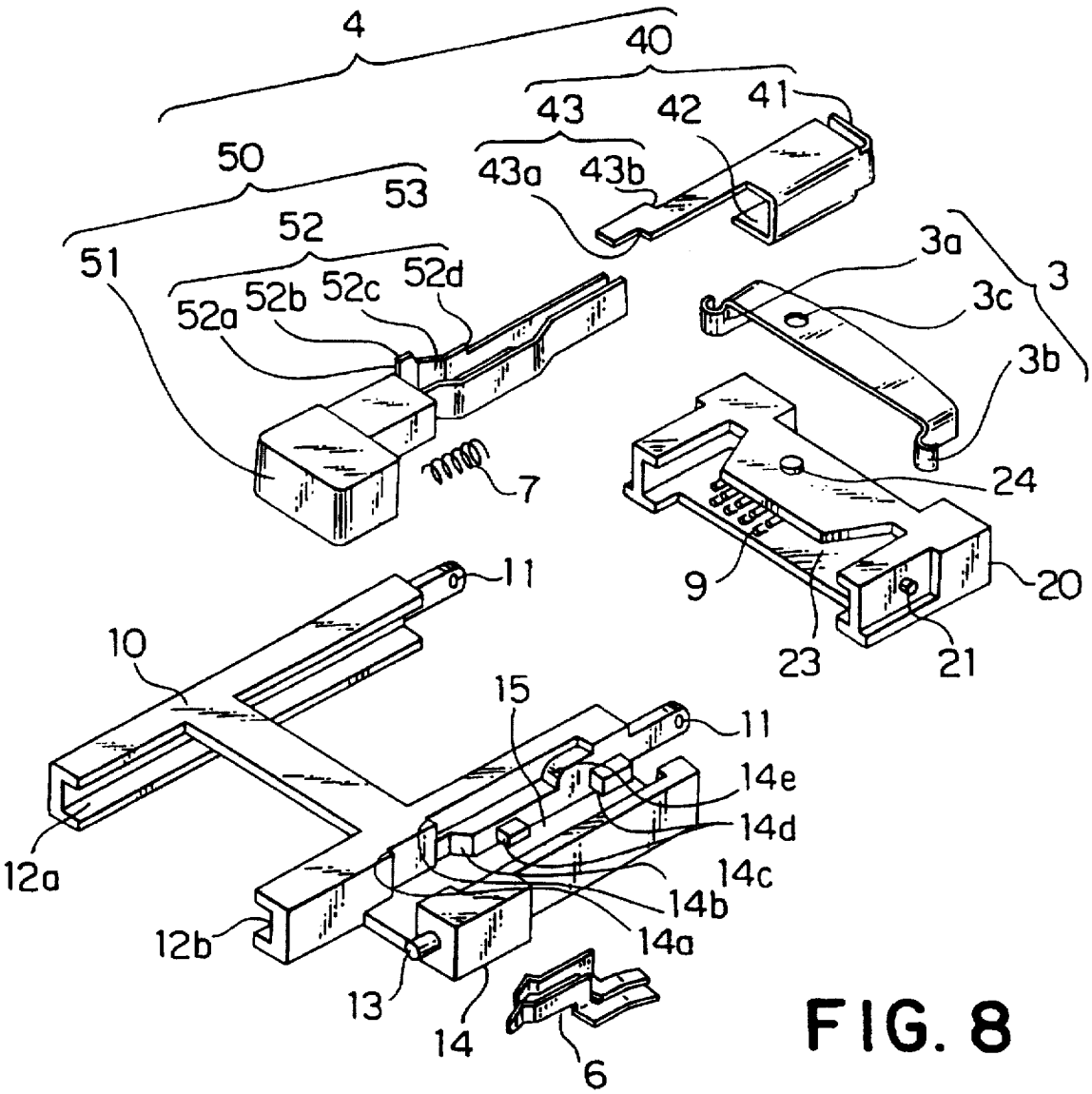
FIG. 8 is an exploded perspective view of an electrical connector illustrated in FIG. 6.

Referring to FIGS. 6, 7, and 8, the connector equipped with a releasing mechanism comprises an insulating frame member 2 and the release mechanism comprising a lever 3 made of a plate material and rotatably mounted on the frame member 2, and an ejector 4 mounted on the frame member 2 to be movable forward and backward.

The frame member 2 comprises a guide frame 10 and a contact frame 20. The guide frame 10 defines an opening 1 at one end of the frame member 2 for insertion of a card 70, such as an IC card and a memory card, having a mating connector 80. The guide frame 10 is provided with a pair of guide portions 12*a* and 12*b* extending in parallel to each other for guiding the card 70 inserted into the frame member 2 in a forward direction depicted by an arrow 81 in FIG. 6.

The contact frame 20 defines a cavity 23 at the opposite end of the frame member 2 for receiving a forward end of the card 70 inserted and fitted therein. The cavity 23 accommodates a plurality of conductive pin contacts 9 to be connected to a plurality of mating contacts (not shown) of the mating connector 80.

As best shown in FIG. 8, the guide frame 10 and the contact frame 20 are coupled to each other by engaging a pair of coupling holes 11 formed on one ends of the guide frame 10 and a pair of coupling pins 21 formed on opposite side surfaces of the contact frame 20.

As described above, the guide frame 10 comprises the guide portions 12*a* and 12*b* extending in parallel to each other. The guide portions 12*a* and 12*b* slidably receive opposite side edges of the card 70 in a travelling direction of the card 70 and guide the card 70 so that the forward end of the card is received in the cavity 23 formed in the contact frame 20. One guide portion 12*b* has a holder portion 14 formed on its outside for movably holding the ejector 4 in forward and backward directions. The holder portion 14 is formed with a groove portion 15 extending in the travelling direction. The groove portion 15 has a side surface provided with a first step 14*a*, a second step 14*b*, a tapered portion 14*c*, two holder elements 14*d*, and a projection 14*e*.

The first step 14*a*, the second step 14*b*, and the tapered portion 14*c* form a first cam surface in which the steps 14*a* and 14*b* serves as stopper at different positions in the travelling direction. The projection 14*e* is formed on an upper surface of the side wall of the groove of the groove 15.

The upper surface including the projection 14e serves as a second cam surface.

The lever 3 has a lever push-out portion 3a, a lever pressed portion 3b, and a shaft receiving hole 3c formed at one end, the other end, and an intermediate portion, respectively. The contact frame 20 is provided with a rotation shaft 24 formed one the upper surface thereof. The lever 3 is rotatably held on the contact frame 20 by rotatably fitting the shaft receiving hole 3c to the rotation shaft 24.

The lever push-out portion 3a is located at a rear side of the cavity 23 when the card 70 is inserted in the frame member 2. In order to remove the card 70 from the frame member 2, the ejector 4 performs a forward movement and pushes the lever pressing portion 3b. This brings about a rotary movement of the lever 3 around the rotation shaft 24. As a consequence, the lever push-out portion 3a is protruded in the cavity 23 to push the card 70 out of the cavity 23 with the mating connector 80 released from connection with the pin contacts 9.

Figure 9:
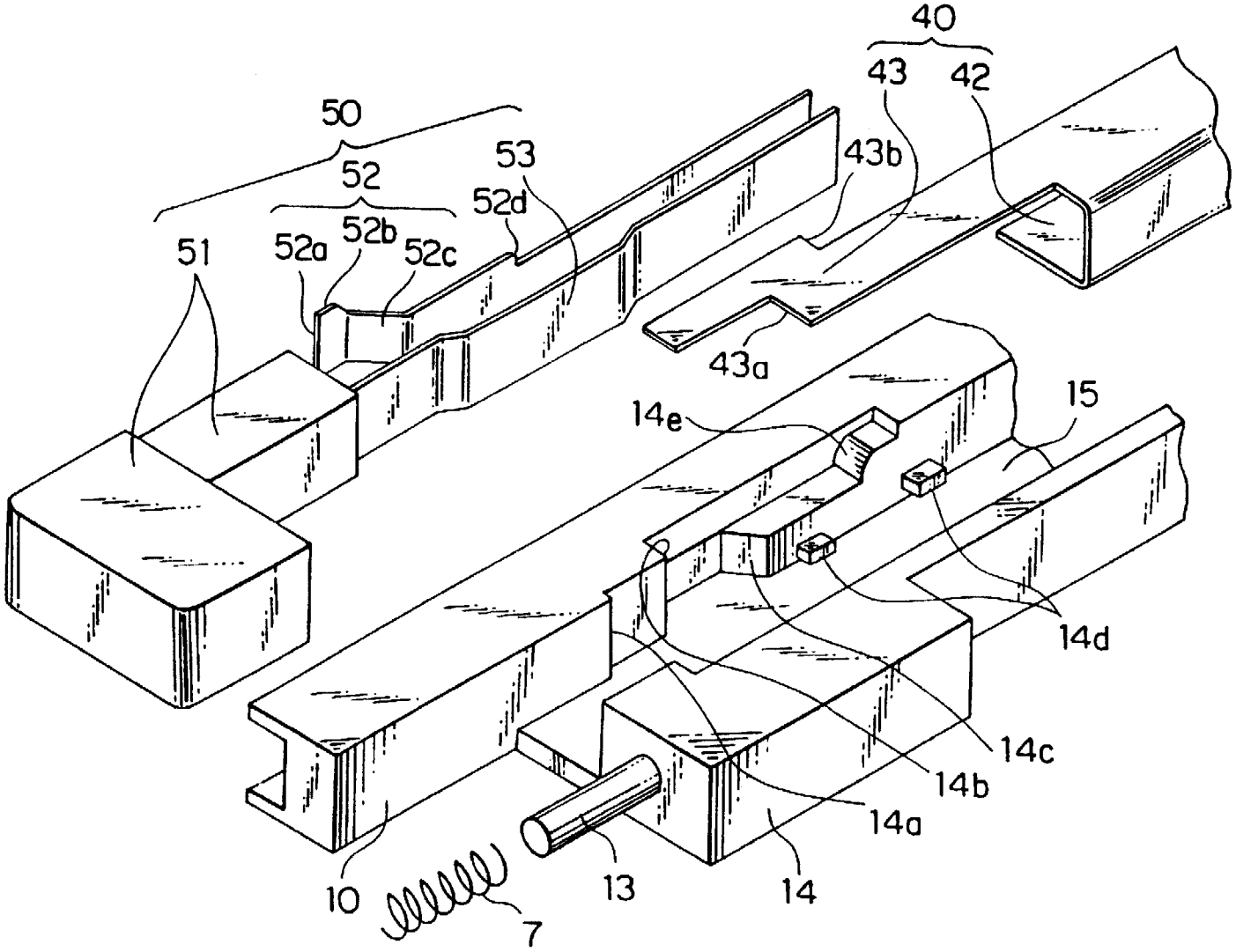
FIG. 9 is en exploded and enlarged perspective view of the ejector illustrated in FIG. 6.

As illustrated in FIGS. 8 and 9 in detail, the ejector 4 comprises an outer member 40 slidably coupled to the groove portion 15 of the holder portion 14, and an inner member 50 combined with the outer member 40. The outer member 40 has a bottom plate portion which is slidably fitted in a gap between the holding elements 14d and a bottom surface of the groove portion 15, so that the outer member is held in groove portion 15 and slidable in the travelling direction. The outer member 40 has a pressed portion 41 for pressing the lever pressing portion 3b of the lever 3, a cavity 42 for receiving the inner member 50, and a first spring portion 43 of a flat shape. The first spring portion 43 is elastically bendable upward and downward in the figure, and is provided with first and second engaging contact portions 43a and 43b formed at two different positions. The inner member 50 comprises a key block portion 51 which is manually operable or pushed by a finger, a second spring portion 52 extending from the key block portion 51 in the forward direction, and an eject bar portion 53 extending in parallel to the second spring portion 52.

The second spring portion 52 has an end face 52a close to the key block portion 51, and upper end surface extending in the forward direction which is provided with a projecting portion 52b projecting upwardly and continuously extending from the end face 52a, a tapered portion 52c continuously extending from the projecting portion 52b, and a step 52d in the order.

The holder portion 14 has a cylinder 13 formed on a rearward end face thereof. The key block portion 51 is provided with a hole (not shown) for receiving the cylinder 13. The cylinder 13 is slidably fitted in the hole through a coil spring 7 and supports the key block portion 51 in a movable condition in the travelling direction.

The ejector 4 is located inward from the opening 1 in a normal condition in which the card 70 is inserted in the frame member 2. The ejector 4 is protruded outward from the opening 1 to achieve a predetermined forward movement of the ejector 4, but only during a releasing operation of card 70.

The ejector 4 has a first mode (see FIG. 7) enabling a predetermined forward movement and a second mode (see FIG. 6) disabling the predetermined forward movement. In the first, the ejector 4 is retained in an elongated condition where the first engagement portion 43a of the outer member 40 engages with the step portion 52d of the inner member 50. In the second mode, the ejector 4 is variable in length where the outer member 40 and the inner member 50 are slidable to each other.

Furthermore, the ejector 4 and the holding portion 14 comprises means for cancelling the first mode of the ejector 4 and putting it into the second mode after releasing the card 70 from the connector, and means for restoring the first mode of the ejector 4 from the second mode so as to release the mating connector from the connection with the conductive contacts 9.

Next, description will proceed to an operation of the ejector 4.

Figure 10:
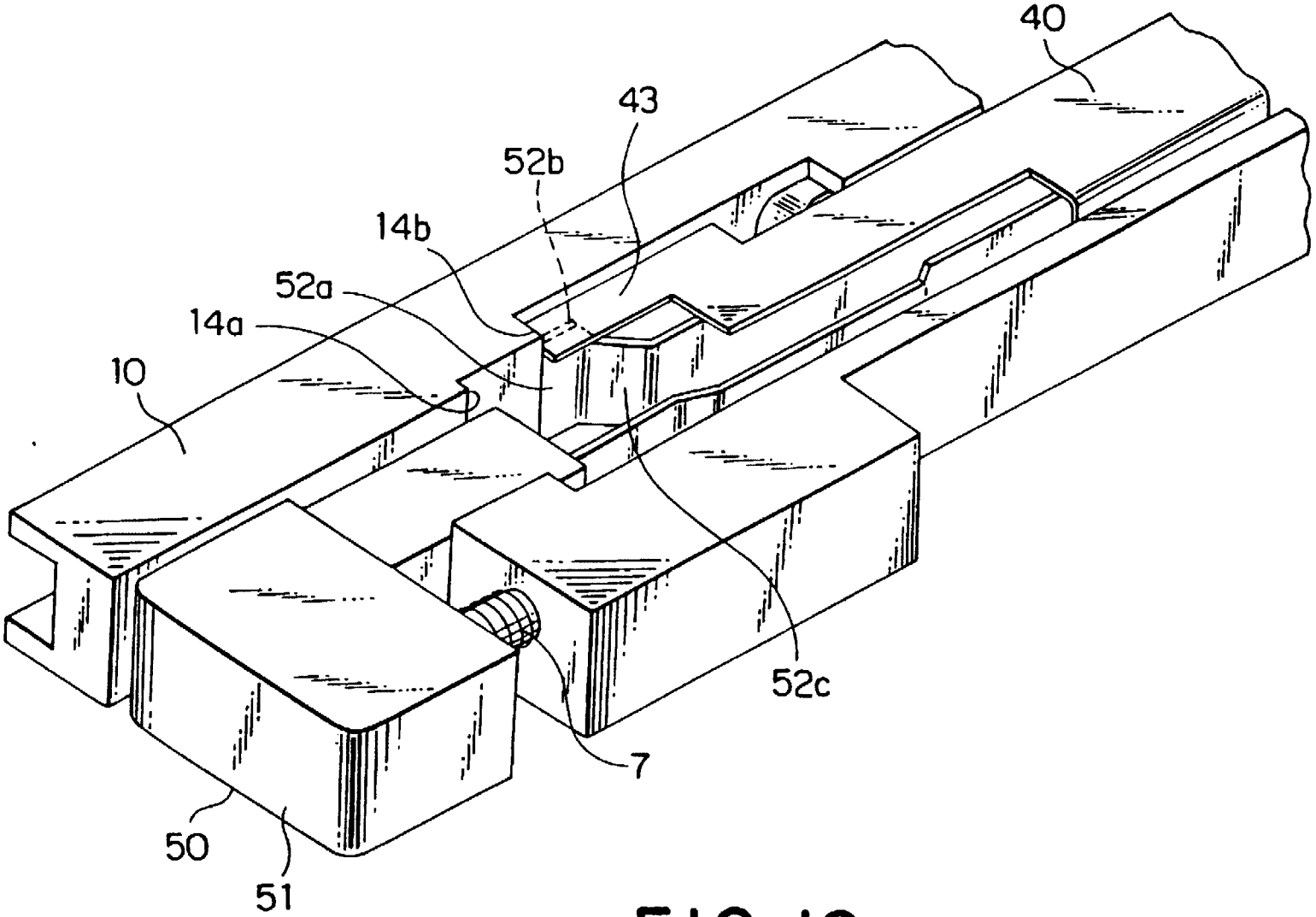
FIG. 10 is an exploded perspective view of the ejector illustrated in FIG. 6 in an initial condition.

Referring to FIG. 10, in an initial condition in which the card 70 is inserted into the frame member 2, the ejector 4 is in the second mode and the inner member 50 of the ejector 4 is disposed at a normal position. That is, the inner member 50 is urged by an elastic restoring force of the coil spring 7 in the backward direction. However, the end face 52a of the second spring portion 52 engages with the second step 14b of the guide frame 10 to stop the inner member 50 from movement in he backward direction. Accordingly, the ejector 4 is maintained in the normal condition as illustrated in FIG. 10. An end plate area of the first spring portion 43 of the outer member 40 is elastically pressed onto the projection 52b of the inner member 50.

Figure 11:
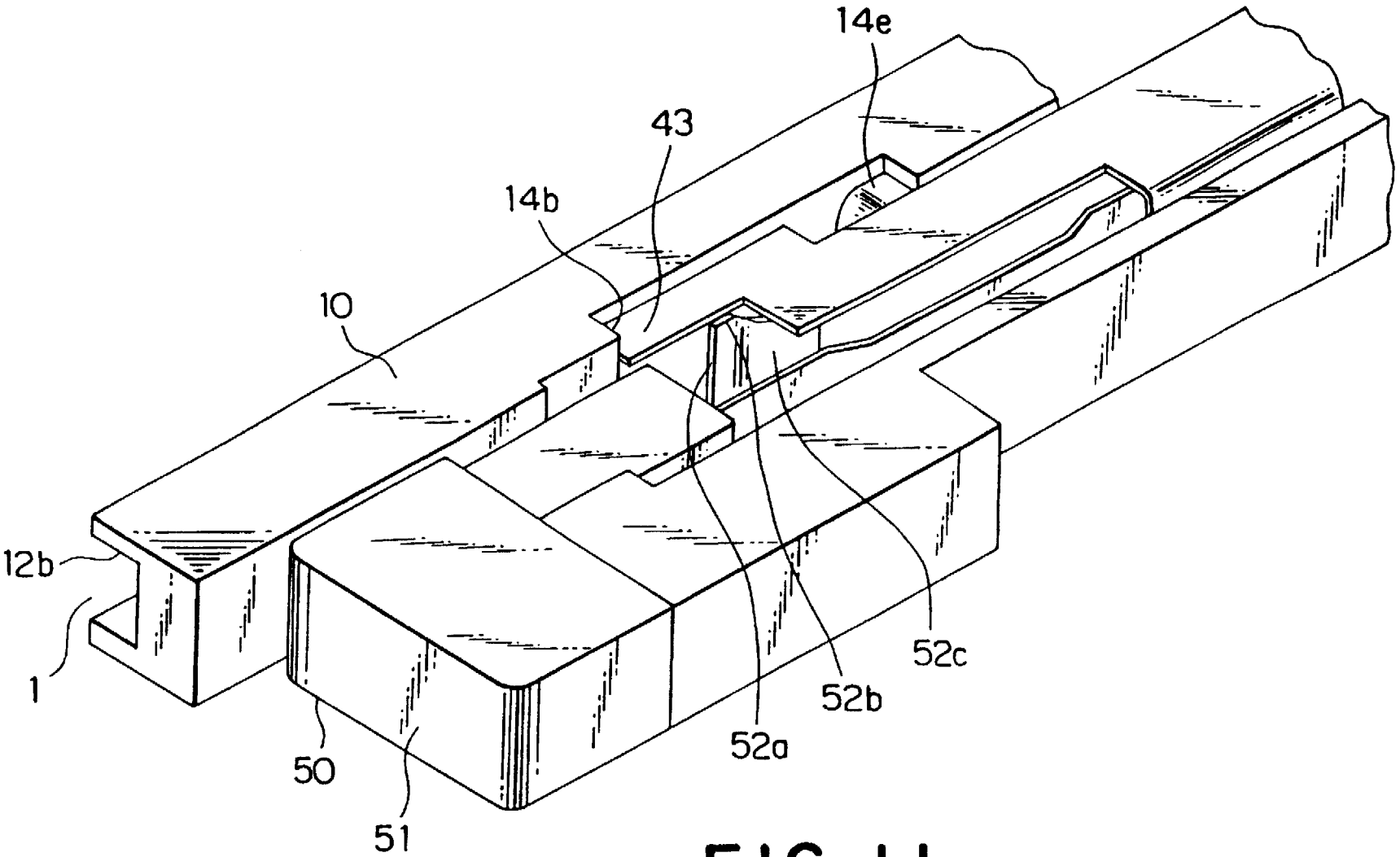
FIG. 11 is an exploded perspective view for describing an operation of protruding the ejector.
Figure 12:
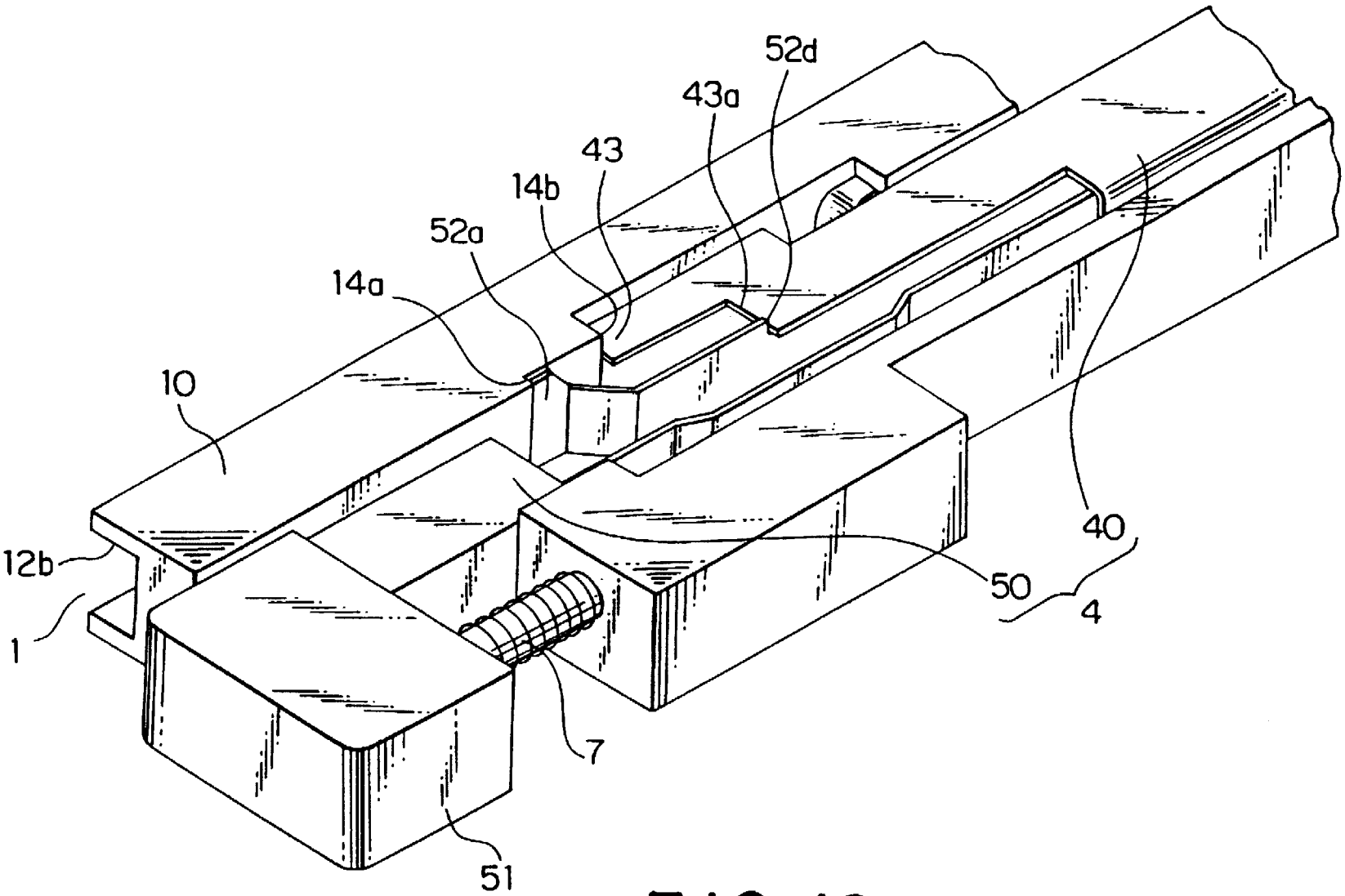
FIG. 12 is an exploded perspective view of the ejector illustrated in FIG. 6 in the protruding condition.

Next, when the key block portion 51 is pushed in the forward direction from the initial condition to move the inner member 50 in the same direction, the tapered portion 52c of the second spring portion 52 of the inner member 50 is brought into contact with the tapered portion 14c of the holder portion 14 and goes over the tapered portion 14c so that the second spring portion 52 is deformed inward of the groove portion 15, as illustrated in FIG. 11. Accordingly, the projecting portion 52b is displaced aside and no longer present under the first spring portion 43. The first spring portion 43 is moved downward and in contact with a side surface of the projecting portion 52b to keep it in a displaced position. In this state, the end face 52a of the second spring portion 52 is released from engagement with the second step 14b. As a consequence, the inner member 50 is moved backwardly by the restoring force of the coil spring 7 and the key block portion 51 is protruded outward from the opening 1, as illustrated in FIGS. 7 and 12. In other words, the ejector 4 is located at the second relative position and restored into the eject mode. When the inner member 50 is protruded as illustrated in FIG. 12, the inner member 50 is stopped by engagement of the end face 52a of the second spring portion 52 with the first step 14a of the guide frame 10.

Thus, the step 52d of the inner member 50 engages with the first engagement portion 43a of the outer member 40 so that the ejector 4 is put into the first mode. In this state, when the key block portion 51 is pushed to force the ejector 4 in the forward direction, the lever 3 is rotated in response to the forward movement of the ejector 4 to release the card 70 together with the mating connector 80, as illustrated in FIG. 13.

Figure 13:
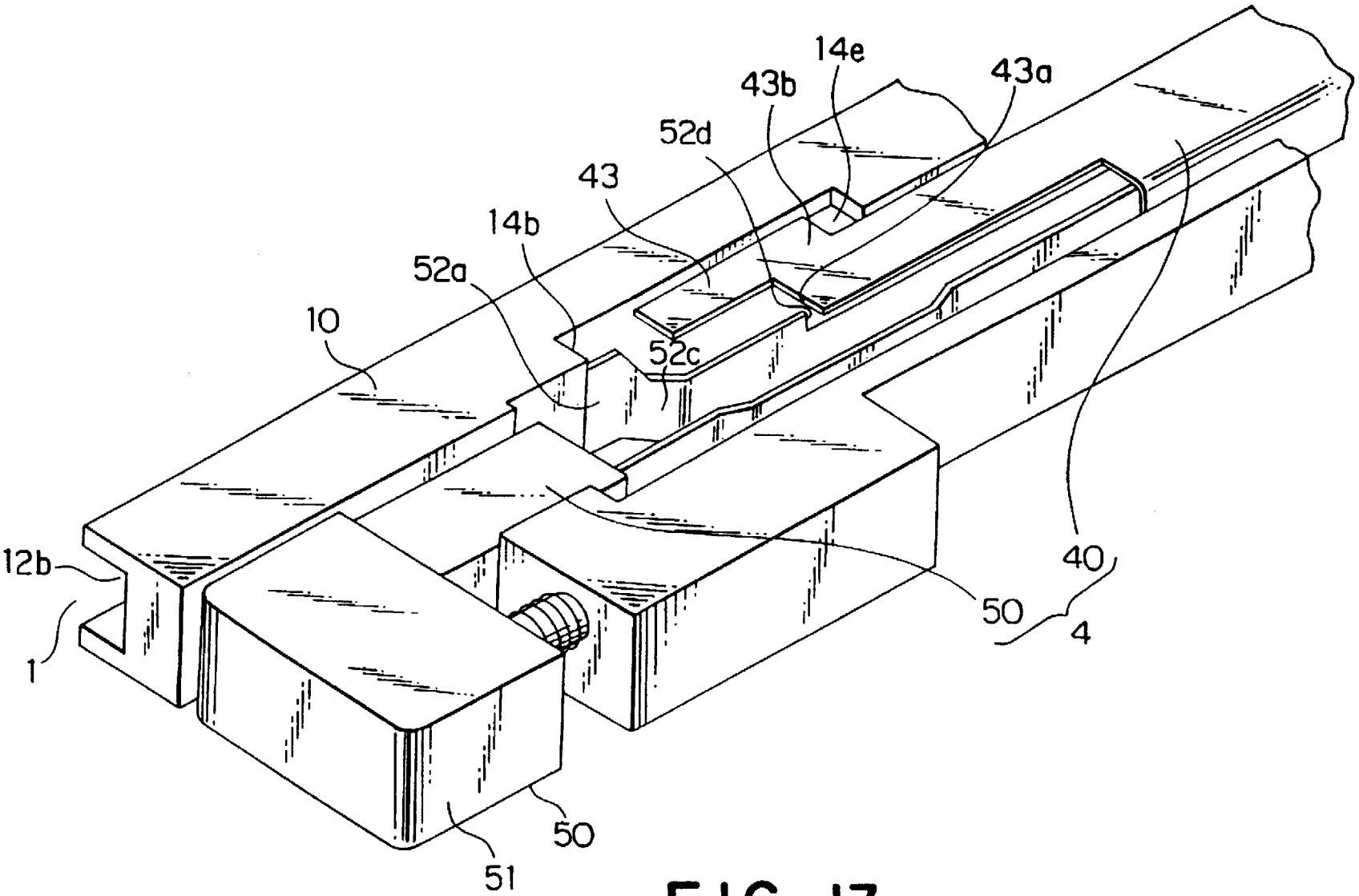

When the ejector 4 is further pushed to move forward further, the second engaging portion 43b of the outer member 40 rides on the projecting portion 14e of the guide frame 10, as illustrated in FIG. 13, so that the first spring portion 43 is elastically deformed upwardly. Accordingly, the engagement of the first engagement portion 43a and the step 52d is released so that the outer member 40 and the inner member 50 becomes slidable to each other. Thus, the ejector 4 is put into the second mode. When the key block portion 51 is further pushed forward, the end face 52a of the second spring portion 52 is brought into contact with the second step 14b of the holding portion 14, so that the key block portion 51 is maintained at the normal position or condition.

On the other hand, when the card 70 is inserted into the frame member 2, the forward end of the card 70 makes the lever 3 rotate. At this time, the outer member 40 of the ejector 4 is pushed in the backward direction to return to the initial condition illustrated in FIG. 10.

Next referring to FIGS. 8 and 14, the electrical connector may have a switch 6 turned from an off state into an on state when the key block portion 51 is moved from the normal condition into the backwardly protruding condition. The switch 6 comprises two similar switching contacts 61 and 62. When the key block portion 51 is in the normal condition, the switching contacts 61 and 62 are out of contact so that the switch 6 is in an off state.

On the other hand, when the key block portion 5 is in the backwardly protruding condition, the eject bar portion 53 pushes the switching contact 62 towards the other switching contact 61, as illustrated in FIG. 15. Accordingly, the switch 6 is put into an on state. Thus, the switch 6 is turned between on and off in response to the position of the key block portion 51.

The on-state of the switch 6 represents a condition where the key block portion 51 projects backwardly and where the ejector 4 is in the first mode. Accordingly, any electrical indicator such as an LED can be provided to indicate the first mode of the ejector. It is thereby avoided that the card is inserted into the connector under a condition the lever is prevented from rotation by the ejector in the first mode.

What is claimed is:

1. An electrical connector equipped with a release mechanism, comprising a plurality of conductive contacts, a frame member supporting the conductive contacts and provided with an opening for receiving a mating connector inserted through said opening so that said mating connector is movable in forward and backward directions to be connected to and released from said conductive contacts, respectively, and a release mechanism for carrying out a predetermined forward movement to release said mating connector from said conductive contacts, said release mechanism comprising an ejector mounted on said frame member to be movable in said forward and said backward directions, a lever which is rotated in response to the forward movement of said ejector to release said mating connector from said conductive contacts and which is rotated by said mating connector and forces said ejector to move in said backward direction when said mating connector is inserted into said frame member, said ejector being located inwardly from said opening in a normal condition in which said mating connector is inserted in said frame member, said ejector being protruded outward from said opening to achieve the predetermined forward movement during a releasing operation of said mating connector, said ejector having a first mode for enabling the predetermined forward movement and a second mode for disabling the predetermined forward movement, said electrical connector further comprising:

means for cancelling said first mode of the ejector to put said ejector into said second mode after said mating connector is released; and means for restoring said first mode of said ejector from said second mode so as to release the mating connector from the connection with the conductive contacts.

2. An electrical connector equipped with a release mechanism as claimed in claim 1, wherein said frame member has a holder portion for holding said ejector to be movable in said forward and said backward directions with respect to said mating connector, said ejector being variable in length in said forward and said backward directions and comprising an outer member and an inner member slidably coupled to each other, said outer member and said inner member being engaged with each other in an elongated condition when said ejector is in said first mode, said outer member and said inner member are out of engagement to each other when said ejector is in said second mode, said holder portion having means for releasing, after releasing said mating connector, engagement between said outer member and said inner member to establish said second mode of the ejector.

3. An electrical connector equipped with a releasing mechanism as claimed in claim 1, wherein said holder portion has a switch turned from an off state into an on state when said ejector is in said first mode while said ejector is protruding from the connector in the backward direction.

* * * * *

UNITED STATES PATENT AND TRADEMARK OFFICE

CERTIFICATE OF CORRECTION

PATENT NO. : 5,695,351

DATED : December 9, 1997

INVENTOR(S) : Akira Kimura and Tadashi Ishiwa

It is certified that error appears in the above-identified patent and that said Letters Patent is hereby corrected as shown below:

Abstract:

Line 7, delete "from" and insert --frame--.

Column 5, Line 48, delete "1441a" and insert --144a--.

Column 6, Line 6, delete "tapered" and insert --guide--.

Column 7, Line 7, delete "one" and insert --on--.

Column 8, Line 18, delete "he" and insert --the--.

Signed and Sealed this

Twenty-eighth Day of April, 1998

Bruce Lehman

*Attest:*

BRUCE LEHMAN

*Attesting Officer*

*Commissioner of Patents and Trademarks*